United States Patent [19]

Ernst et al.

[11] Patent Number: 4,680,009

[45] Date of Patent: Jul. 14, 1987

[54] APPARATUS FOR REMOVING OVERSIZE FROM THE HOT MATERIAL DISCHARGED FROM A ROTARY KILN USED TO PRODUCE SPONGE IRON BY A DIRECT REDUCTION OF IRON OXIDE CONTAINING MATERIALS

[75] Inventors: Helmut Ernst, Offenbach am Main; Alfred Breier, Frankfurt am Main; Manfred Schwalbach, Florsheim; Karl-Heinz Will, Oberursel, all of Fed. Rep. of Germany; Alan B. Cameron, Manurewa; Peter C. Bates, Waiuku, both of New Zealand

[73] Assignees: Metallgesellschaft Aktiengesellschaft, Frankfurt, Fed. Rep. of Germany; New Zealand Steel Ltd, Auckland, New Zealand

[21] Appl. No.: 893,113

[22] Filed: Aug. 1, 1986

[30] Foreign Application Priority Data

Aug. 1, 1985 [DE] Fed. Rep. of Germany ..... 3527621

[51] Int. Cl.[4] ..... F27B 7/32

[52] U.S. Cl. ..... 432/117; 432/77; 432/79; 110/222

[58] Field of Search ..... 432/77, 79, 81, 86, 432/117, 239; 110/222

[56] References Cited

U.S. PATENT DOCUMENTS

| | | | |
|---|---|---|---|
| 2,225,283 | 12/1940 | Voigtlaender et al. | 432/117 |
| 3,427,367 | 2/1969 | Jean-Pierre | 432/79 |
| 3,584,587 | 6/1971 | Siraccusa | 110/222 |
| 3,589,313 | 6/1971 | Smith et al. | 110/222 |
| 3,831,291 | 8/1974 | Kayatz | 432/77 |
| 4,076,493 | 2/1978 | Gandner | 432/77 |
| 4,141,154 | 2/1979 | Buchner | 432/77 |
| 4,629,421 | 12/1986 | Kreisberg et al. | 432/77 |

FOREIGN PATENT DOCUMENTS 3123589 1/1983 Fed. Rep. of Germany .

*Primary Examiner*—Henry C. Yuen

*Attorney, Agent, or Firm*—Sprung Horn Kramer & Woods

[57] ABSTRACT

The discharge end of the rotary kiln (24) is surrounded by and gas-tightly sealed to a stationary kiln head (2), which contains a rigid, cooled, inclined grate (1). A container (3) for collecting oversize is mounted on the kiln head (2) and is provided at its discharge end with a gate valve (4). The collecting container (3) is surrounded by and gas-tightly sealed to an outer container (5) and is provided with a gas-tight flap valve (6) and with a fitting (7) for a gas-tight connection to a transport container (8). Under the grate (1) the kiln head (2) constitutes a buffer bin (9) for the particles falling through the grate. The buffer bin (9) is succeeded by a batching bin (10), which is provided with a gas-tight upper shutoff valve (11). On its discharge side, the batching bin (10) is provided with a gas-tight lower shutoff valve (12) and with a fitting (13) for a gas-tight connection to a transport container (14). The volume of the batching bin (10) is smaller than the volume of the transport container (14).

7 Claims, 4 Drawing Figures

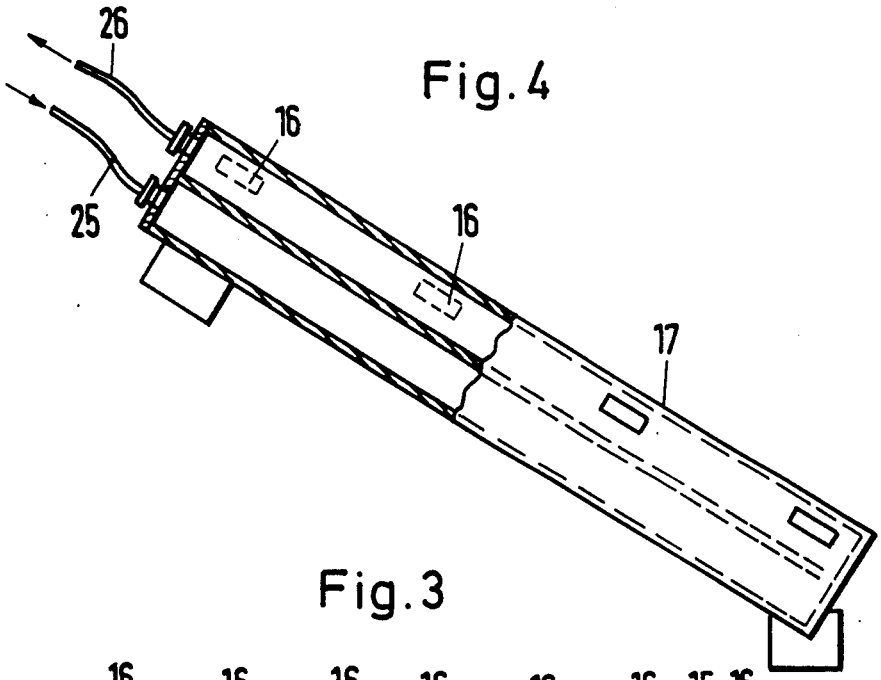
Fig. 4
Fig. 3
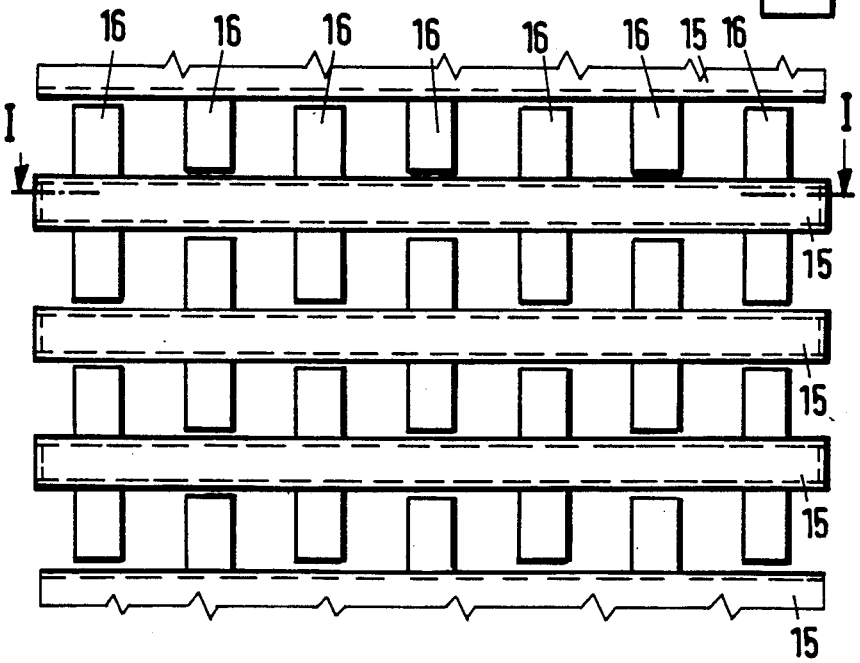

APPARATUS FOR REMOVING OVERSIZE FROM THE HOT MATERIAL DISCHARGED FROM A ROTARY KILN USED TO PRODUCE SPONGE IRON BY A DIRECT REDUCTION OF IRON OXIDE CONTAINING MATERIALS

BACKGROUND OF THE INVENTION

This invention relates to apparatus for removing oversize from the hot material discharged from a rotary kiln used to produce sponge iron by a direct reduction of iron oxide containing materials, which apparatus comprises a stationary kiln head, which surrounds and is gas-tightly sealed to the discharge end of the rotary kiln, an oversize discharge device provided on the kiln head, and a discharge device for the particles which have passed through a sieve-like separator.

The material discharged from a rotary kiln consists of a mixture of sponge iron, surplus coal, ash and, possibly, desulfurizing agent. That material is discharged at a temperature of about 800° to 1200° C. In addition to particles of normal size, the discharged material may contain also oversize lumps, such as detached crusts, agglomerated portions of the charge or pieces of the refractory lining. Such oversize must be removed from the discharged material before the latter is melted. If the discharged material is to be charged in a hot state into the melting furnace, the oversize must be removed from the discharged material while it is in a hot state and an access of air to the discharged material must be prevented in order to avoid a reoxidation. In some cases the fines are also to be removed in a hot state by sieving before the material is charged into the melting furnace, and a reoxidation must be prevented in that case too.

Published German application Ser. No. 31 33 589 discloses a separator in which a coarse grate for removing the oversize is disposed in the kiln head and the oversize falls through a flap valve out of the kiln head. A vibrating sieve is disposed under the coarse grate. The fines fall through a chute into a cooling drum, and the desired product falls from the sieve through a chute into a transport container which is discharged into an electric furnace. In that arrangement the transport container may be overfilled and such overfilling will give rise to considerable problems. Besides, the rotary kiln must be stopped when the transportation of the product is disturbed.

SUMMARY OF THE INVENTION

It is an object of the invention to permit an undisturbed withdrawal and transportation of the hot material which has been separated and to avoid a stoppage of the rotary kiln.

In accordance with the invention that object is accomplished in that the sieve-like separator consists of a rigid, cooled, inclined grate, a collecting container for collecting the oversize is mounted on the kiln head and is provided at its discharge end with a gate valve, the collecting container is surrounded by and gas-tightly sealed to an outer container, which is provided with a gas-tight flap valve and with a fitting for a gas-tight connection to a transport container, the kiln head is designed to form a buffer bin under the grate for the particles falling through the grate, the buffer bin is succeeded by a batching bin, which is provided with a gas-tight upper shutoff valve, the batching bin is provided on its discharge side with a gas-tight lower shutoff valve and with a fitting for a gas-tight connection to a transport container, and the volume of the batching bin is smaller than the volume of the transport container.

One of the conventional seals for preventing an ingress of air is provided between the stationary kiln head and the adjacent end of the rotary kiln, which end rotates in the kiln head. The kiln head maybe mounted on wheels in order to facilitate repairs. The grate may be cooled by liquid or gaseous cooling fluids, which are introduced into the grate and flow through the grate or parts and are subsequently withdrawn from the grate. Water is usually employed as a cooling fluid. The container for collecting the oversize suitably consists of an inclined chute, which receives the oversize falling from the grate and in which the oversize is collected when the gate valve is closed. The outer container surrounds the discharge end of the collecting container and is gas-tightly connected to the latter and designed to accommodate the gate valve in its open position and to permit an accommodation of the flap valve in the outer container below the discharge end of the collecting container.

When a transport container is connected to the outer container, the gate valve and the flap valve may be in an open position so that oversize will fall directly into the transport container.

When the oversize is collected in the collecting container because the gate valve is closed, the flap valve will be opened before the collecting container is emptied so that oversize cannot fall onto the closed flap valve. The gas-tight valves provided between the buffer bin and the batching bin and at the discharge end of the batching bin suitably consist of gas-tight gate valves. Because the volume of the batching bin is smaller than the volume of the transport container, an overfilling of the transport container will be prevented and the gate valve need not be closed against the column of material. The batching bin suitably has a usable volume of 75 to 90%, preferably about 85%, of the suitable volume of the transport container. When the discharge gate valve is closed and the inlet gate valve is opened, the batching bin is preferably charged from the buffer bin in such a manner that the batching bin is not completely filled so that the upper gate valve need not be closed against a column of material. To that end, the duration of the periods in which the batching bin is being filled with material from the buffer bin is suitably so selected that the volume of material contained in the buffer bin is smaller than the usable volume of the batching bin. That duration may be determined, e.g., by measuring probes.

In a preferred embodiment, the gate valve provided on the collecting container consists of a segment-like gate valve. A segment-like gate valve has a very low susceptibility to damage by impinging hot oversize.

In a preferred embodiment the gate extends at an angle of 25 to 32 degrees to the horizontal. With that inclination, a particularly effective separation can be performed whereas there is no risk of a clogging of the grate.

In a preferred embodiment, the grate consists of cooled longitudinal bars and transverse bars disposed below the plane of the sliding surface of the longitudinal bars. Such an arrangement ensures that the material can slip freely and that relatively large slate-like pieces cannot fall through the grate. Besides, a deformation of the longitudinal bars and a resulting expansion of the openings between the longitudinal bars will be prevented. The transverse bars need not be cooled.

In a preferred embodiment the transverse bars are secured only at one end to the longitudinal bars. That arrangement will prevent a transmission of thermal expansion and will facilitate a replacement.

In a preferred embodiment an overflow is provided between the buffer bin and the collecting container. The overflow permits all material to be discharged via one of the two discharge routs if there is a disturbance in the other discharge route.

In a preferred embodiment a driven sieve which has an inclination that is opposite to the inclination of the grate is disposed under the grate, the coarses fall into the buffer bin, a second buffer bin for the fines passing through the sieve is disposed between the buffer bin and the collecting container, and the second buffer bin is provided with a gas-tight valve and is connected by a connecting line to a cooler. In such an arrangement a coarse product fraction can be separated in a hot state from the fines (abraded fines, ash, desulfurizing agent, surplus coal) if such separation is required before the further processing. The cooler is gas-tightly connected to the connecting line and communicates with the kiln atmosphere. Cooling is indirectly effected. The structure which carries the sieve is cooled.

The invention will be explained more in detail with reference to the drawings.

BRIEF DESCRIPTION OF THE DRAWINGS

FIG. 3 is a enlarged top plan view showing a portion of the cooled grate for removing oversize.

FIG. 4 is a sectional view taken on line I—I in FIG. 3.

DETAILED DESCRIPTION OF THE INVENTION

Figure 1:
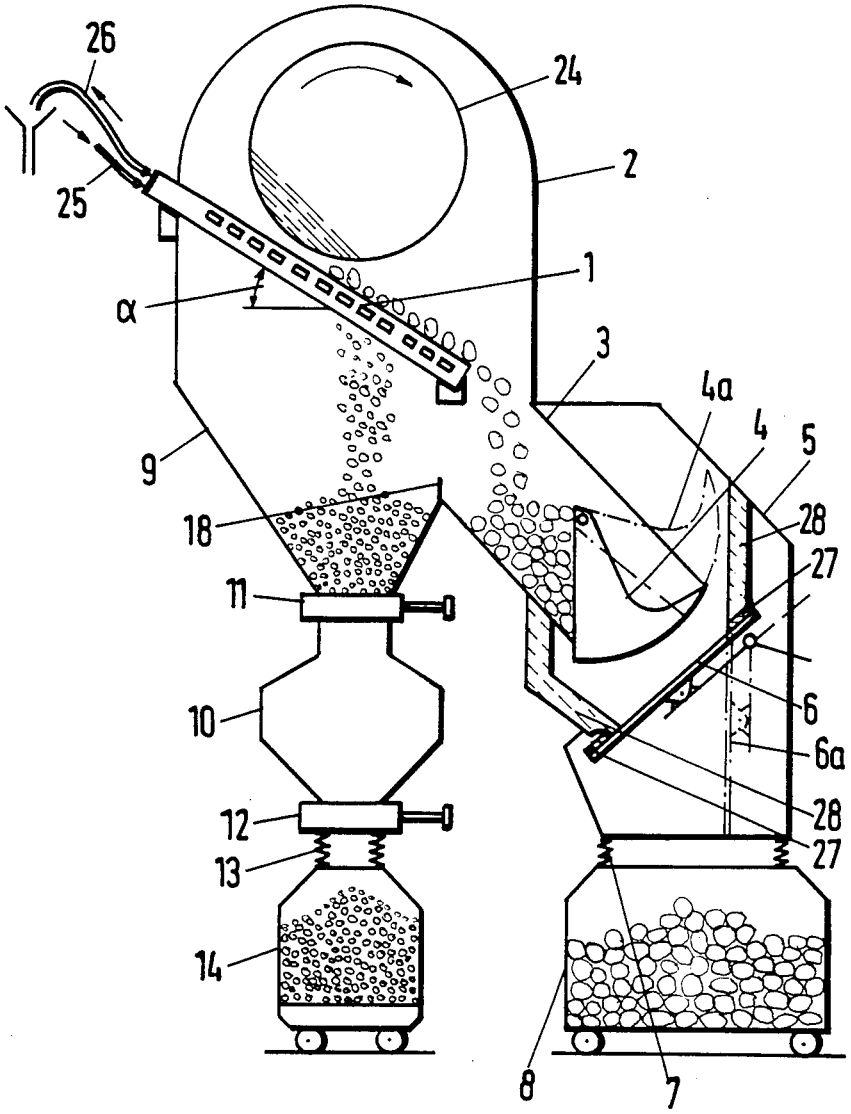
FIG. 1 is a transverse sectional view showing a kiln head provided with means for removing oversize and means for discharging the product.

Referring now to FIG. 1, a stationary kiln head 2 surrounds and is gas-tightly sealed to a discharge end of rotary kiln 24. The material discharged from the kiln falls on a rigid grate 1. Cooling water is introduced into the grate 1 through line 25 and heated cooling water is withdrawn through line 26. The grate 1 extends at an angle of 30°. Oversize falls from the end of the grate 1 into collecting container 3, which is closed at its discharge end by a segment-like gate valve 4. The collecting container 3 and the segment-like gate valve 4 are surrounded by and gas-tightly sealed to the outer container 5, which accommodates gas-tight flap valve 6, which is in sealing contact with seals 27 secured to walls 28. The seal 27 is so arranged that it is disposed outside the stream of material. A telescopic fitting 7 for a gas-tight connection to transport container 8 is provided at the lower end of the outer container 5. When it is desired to empty the collecting container 3, the flap valve 6 is moved to its open position 6*a* and the segment-like gate valve 4 is subsequently moved to its open position 4*a*. The material falling through the grate 1 drops into a buffer bin 9. A gas-tight gate valve 11 is provided at the lower end of the buffer bin 9 and is succeeded by batching bin 10. The batching bin 10 is provided at its lower end with a gas-tight gate valve 12. The gate valve 12 is succeeded by a telescopic fitting 13 for a gas-tight connection to transport container 14. The actuators for the valves are interconnected in such a manner that wrong control actions will be prevented. The buffer bin 9 and the collecting container 3 communicate with each other over an overflow, which is provided by a weir 18, so that the operation of the rotary kiln need not be interrupted immediately when a disturbance has arisen on a transport route.

Figure 2:
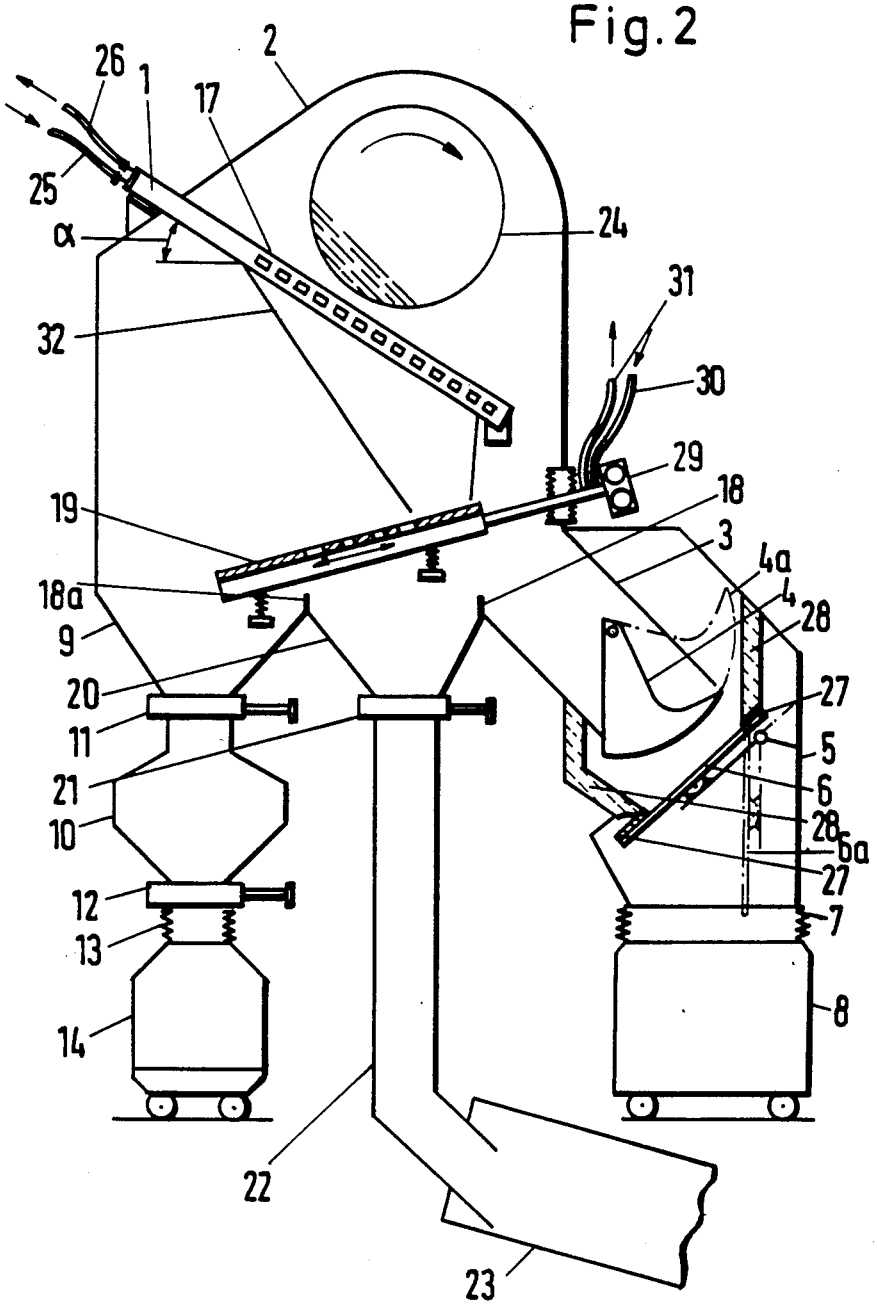
FIG. 2 is a transverse sectional view showing a kiln head provided with means for removing oversize and means for separating the material which has passed through the grate into a coarse product fraction and a fine fraction.

In the embodiment shown in FIG. 2, a mechanically driven sieve 19 is additionally provided in the kiln head 2 below the grate 1. That sieve has an inclination which is opposite to that of the grate 1. The actuator 29 for the sieve 19 is disposed outside the kiln head 2. The structure which carries the sieve is cooled by means of cooling water, which is introduced via line 30 and withdrawn via line 31. The material which falls through the grate 1 is fed to the sieve 19 through the chute 32. The coarse product fraction falls from the sieve 19 into the buffer bin 9. The fines passing through the sieve fall into a second buffer bin 20, which is provided at its lower end with a gas-tight gate valve 21. The gate valve 21 is succeeded by a line 22, which is gas-tightly connected to the tubing cooler 23. The gate valve 21 may always be open and may be closed only for repairs. An overflow weir 18*a* is provided between the buffer bin 9 and the second buffer bin 20.

The grate 1 shown in FIGS. 3 and 4 consists of longitudinal bars 15, each of which has a water inlet 25 and a water outlet 26, and transverse bars 16, which are secured to the longitudinal bars 15 below the plane of the sliding surfaces 17 of the longitudinal bars. Each transverse bar 16 is secured only at one end to a longitudinal bar 15 so that constraints due to thermal expansion will be avoided.

The advantages afforded by the invention reside in that the hot material which has been separated can be discharged into transport containers without any access of air and that the volume which is discharged is exactly controlled so that an overfilling of the transport containers will reliably be avoided. Besides, in case of a disturbance on one transport route the other transport route can be used to discharge the entire material so that an immediate stoppage of the rotary kiln will be avoided.

It will be appreciated that the instant specification and claims are set forth by way of illustration and not limitation, and that various modifications and changes may be made without departing from the spirit and scope of the present invention.

What is claimed is:

1. In an apparatus for removing oversize from hot material discharged from a rotary kiln used to produce sponge iron by a direct reduction of iron oxide containing materials, the apparatus comprising a stationary kiln head which surrounds and is gas-tightly sealed to a discharge end of a rotary kiln, an oversize discharge device on the kiln head, and a discharge device for the particles which have passed through a sieve-like separator, the improvement wherein: the sieve-like separator comprises a rigid, inclined grate, means for cooling the grate and further comprising: a collecting container for collecting oversize mounted on the kiln head and having a gate valve at the discharge end thereof, an outer container surrounding and gas-tightly sealed to the collecting container and having a gas-tight flap valve, a transport container, a fitting for a gas-tight connection between the collecting container and the transport container, wherein the kiln head is configured to form at least one buffer bin under the grate for the particles falling through the grate, a batching bin under the buffer bin and having a gas-tight upper shutoff valve, a second transport container, the batching bin having: on its discharge side a gas-tight lower shutoff valve with a fitting for a gas-tight connection to the second transport container, and wherein the volume of the batching bin is smaller than the volume of the second transport container.

2. The apparatus according to claim 1, wherein the gate valve on the collecting container comprises a segment-like gate valve.

3. The apparatus according to claim 1, wherein the grate extends at an angle of 25 to 32 degrees to the horizontal.

4. The apparatus according to claim 1, wherein the grate comprises coolable longitudinal bars and transverse bars, which are disposed below the plane of the sliding surfaces of the longitudinal bars.

5. The apparatus according to claim 4, wherein the transverse bars are secured only at one end to the longitudinal bars.

6. The apparatus according to claim 1, further comprising an overflow between the buffer bin and the collecting container.

7. The apparatus according to claim 1, further comprising a driven sieve which has an inclination that is opposite to the inclination of the grate is disposed under the grate, such that the coarses fall into the buffer bin, wherein the kiln head forms a second buffer bin for the fines passing through the sieve and disposed between the first mentioned buffer bin and the collecting container, and wherein the second buffer bin has a gas-tight valve and is connected by a connecting line to a cooler.

* * * * *